US009188998B2

(12) United States Patent
Yano et al.

(10) Patent No.: US 9,188,998 B2
(45) Date of Patent: Nov. 17, 2015

(54) CONSTANT VOLTAGE CIRCUIT

(71) Applicant: FUJITSU SEMICONDUCTOR LIMITED, Yokohama-shi (JP)

(72) Inventors: Yuma Yano, Yokohama (JP); Akimitsu Tajima, Yokohama (JP); Hideaki Kondo, Sagamihara (JP)

(73) Assignee: SOCIONEXT INC., Yokohama-shi (JP)

( * ) Notice: Subject to any disclaimer, the term of this patent is extended or adjusted under 35 U.S.C. 154(b) by 428 days.

(21) Appl. No.: 13/678,629

(22) Filed: Nov. 16, 2012

(65) Prior Publication Data

US 2013/0134954 A1 May 30, 2013

(30) Foreign Application Priority Data

Nov. 24, 2011 (JP) ..... 2011-256044

(51) Int. Cl.
*G05F 1/10* (2006.01)
*G05F 1/56* (2006.01)
*G05F 3/24* (2006.01)

(52) U.S. Cl.
CPC .. *G05F 1/10* (2013.01); *G05F 1/56* (2013.01); *G05F 3/247* (2013.01)

(58) Field of Classification Search
CPC ..... G05F 1/10; G05F 1/56; G05F 1/565; G05F 1/59; G05F 1/618; G05F 3/247; G05F 3/26
USPC ..... 323/273–281, 313–317
See application file for complete search history.

(56) References Cited

U.S. PATENT DOCUMENTS

| | | | | |
|---|---|---|---|---|
| 6,188,212 | B1 * | 2/2001 | Larson et al. | 323/281 |
| 6,215,291 | B1 * | 4/2001 | Mercer | 323/313 |
| 6,586,958 | B2 | 7/2003 | Sudo et al. | |
| 6,801,033 | B2 | 10/2004 | Sudo et al. | |
| 6,861,832 | B2 * | 3/2005 | Perez | 323/316 |
| 7,030,686 | B2 | 4/2006 | Itoh | |
| 7,358,709 | B2 | 4/2008 | Itoh | |
| 7,531,994 | B2 | 5/2009 | Itoh | |
| 7,548,044 | B2 | 6/2009 | Itoh et al. | |
| 7,821,242 | B2 | 10/2010 | Takagi | |
| 8,004,257 | B2 | 8/2011 | Imura et al. | |

(Continued)

FOREIGN PATENT DOCUMENTS

| | | |
|---|---|---|
| CN | 1701292 | 11/2005 |
| CN | 101019415 | 8/2007 |

(Continued)

OTHER PUBLICATIONS

CNOA—Office Action of Chinese Patent Application No. 201210477602.7 dated May 6, 2014 with full English-language translation of the Office Action.

(Continued)

*Primary Examiner* — Jessica Han
(74) *Attorney, Agent, or Firm* — Westerman, Hattori, Daniels & Adrian, LLP

(57) ABSTRACT

In a constant voltage circuit including: an error amplifier circuit amplifying a difference voltage between an output voltage and a reference voltage; and an output transistor controlling the output voltage based on an output of the error amplifier circuit, a voltage proportional to a leakage current detected by a monitoring transistor is generated by an oscillation circuit and a charge pump circuit and is supplied to a back gate of the output transistor.

17 Claims, 10 Drawing Sheets

(56) References Cited

U.S. PATENT DOCUMENTS

| | | | |
|---|---|---|---|
| 2004/0239304 | A1 | 12/2004 | Perez |
| 2005/0248391 | A1 | 11/2005 | Itoh |
| 2007/0114982 | A1 | 5/2007 | Itoh et al. |
| 2009/0086106 | A1 | 4/2009 | Takama |
| 2009/0206807 | A1 | 8/2009 | Imura et al. |
| 2010/0156367 | A1 | 6/2010 | Takagi |

FOREIGN PATENT DOCUMENTS

| | | | |
|---|---|---|---|
| CN | 101341453 | | 1/2009 |
| CN | 101567628 | | 10/2009 |
| JP | 2001-034349 | A | 2/2001 |
| JP | 2002-116829 | | 4/2002 |
| JP | 2004-094788 | | 3/2004 |
| JP | 2006-134268 | A | 5/2006 |
| JP | 2006-309569 | | 11/2006 |
| JP | 2007-206948 | | 8/2007 |

OTHER PUBLICATIONS

Office Action dated Apr. 21, 2015, issued in corresponding Japanese Patent Application No. 2011-256044 with English partial translation (5 pages).

* cited by examiner

CONSTANT VOLTAGE CIRCUIT

CROSS-REFERENCE TO RELATED APPLICATION

This application is based upon and claims the benefit of priority of the prior Japanese Patent Application No. 2011-256044, filed on Nov. 24, 2011, the entire contents of which are incorporated herein by reference.

FIELD

The embodiments are related to a constant voltage circuit.

BACKGROUND

As a constant voltage circuit that steps down a power supply voltage (an input voltage) to be supplied and generates a constant voltage to output it to a load coupled to its output terminal, a linear regulator circuit such as an LDO (Low Drop Out) circuit exists. FIG. 12 is a circuit diagram depicting a configuration example of a conventional linear regulator circuit. In FIG. 12, 101 denotes an error amplifier circuit, 102 denotes an output transistor using a P-channel transistor, and 103 denotes a load coupled to an output terminal of the linear regulator circuit. Further, Vref denotes a constant reference voltage supplied from a not-illustrated reference voltage circuit and Vout denotes an output voltage output from the output terminal of the linear regulator circuit.

In the linear regulator circuit depicted in FIG. 12, when the output voltage Vout becomes lower than the reference voltage Vref, an output voltage of the error amplifier circuit 101, namely a voltage to be supplied to a gate of the output transistor 102 drops. As a result, an on resistance of the output transistor 102 reduces and the output voltage Vout rises. Conversely, when the output voltage Vout becomes higher than the reference voltage Vref, the output voltage of the error amplifier circuit 101 rises. As a result, the on resistance of the output transistor 102 increases and the output voltage Vout drops. In this manner, the output voltage Vout output from the output terminal of the linear regulator circuit is maintained to the reference voltage Vref being a constant voltage.

Here, in the linear regulator circuit depicted in FIG. 12, when in the case of a current flowing through the load being quite small, a leakage current flowing between a drain and a source of the output transistor 102 increases such as at the time of high temperature, the output voltage Vout becomes uncontrollable to rise up to a power supply voltage level. This is because even though the output transistor 102 operates in an off direction according to the output of the error amplifier circuit 101, the output voltage Vout continues to rise due to the leakage current generated in the output transistor 102.

In order to avoid the above problem, there has been proposed a method in which a high voltage is supplied to a back gate (that is also referred to as a substrate gate) of an output transistor to thereby increase a threshold voltage of the output transistor and reduce a leakage current of the output transistor (see, for example, Patent Documents 1 and 3). In the Patent Document 1, in order to suppress the leakage current of the output transistor, there has been disclosed a configuration in which according to an operation mode, a voltage to be supplied to a back gate of an output transistor is switched by a switch. In the Patent Document 1, at the time of a standby mode when a load is brought into a low current consumption state rather than a normal operation, for suppressing the leakage current, it is controlled that a voltage HVcc higher than a voltage LVcc at the time of the normal operation is input to the back gate of the output transistor. Further, in the Patent Document 3, there has been disclosed a configuration in which a voltage to be supplied to a back gate of an output transistor is switched from VDD1 to VDD2 (>VDD1) when it becomes a certain temperature or higher, and thereby a leakage current of the output transistor under a high temperature condition is suppressed. Further, there has been proposed a technique in which according to a drive current value of an output transistor, a voltage to be supplied to a back gate of the output transistor is switched by a switch (see, for example, Patent Document 2).

[Patent Document 1] Japanese Laid-open Patent Publication No. 2007-206948

[Patent Document 2] Japanese Laid-open Patent Publication No. 2002-116829

[Patent Document 3] Japanese Laid-open Patent Publication No. 2004-94788

In the above-described conventional constant voltage circuit, the voltage to be supplied to the back gate of the output transistor is switched by a switch, but there is a problem that in the switching operation, a rapid fluctuation in the output voltage due to switching noise is caused. The above fluctuation in the output voltage causes malfunctions of a logic circuit and an analog circuit caused by power noise, element breakdown by occurrence of a pulse voltage equal to or higher than a withstand voltage, and the like.

SUMMARY

One aspect of a constant voltage circuit includes: an error amplifier circuit configured to amplify a difference voltage between an output voltage and a reference voltage; an output transistor configured to control the output voltage based on an output of the error amplifier circuit; a detection circuit configured to detect a leakage current of the output transistor; and a first voltage generation circuit configured to generate a voltage proportional to the leakage current detected by the detection circuit. The first voltage generation circuit raises a voltage to be generated according to an increase in the leakage current, and an output of the first voltage generation circuit is coupled to a back gate of the output transistor.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, embodiments will be explained based on the drawings.

A constant voltage circuit in each of the embodiments that will be explained below is a constant voltage circuit that steps down a power supply voltage VDD to be input and generates a constant voltage to output it to a load from its output terminal as an output voltage Vout.

(First Embodiment)

A first embodiment will be explained.

Figure 1A:
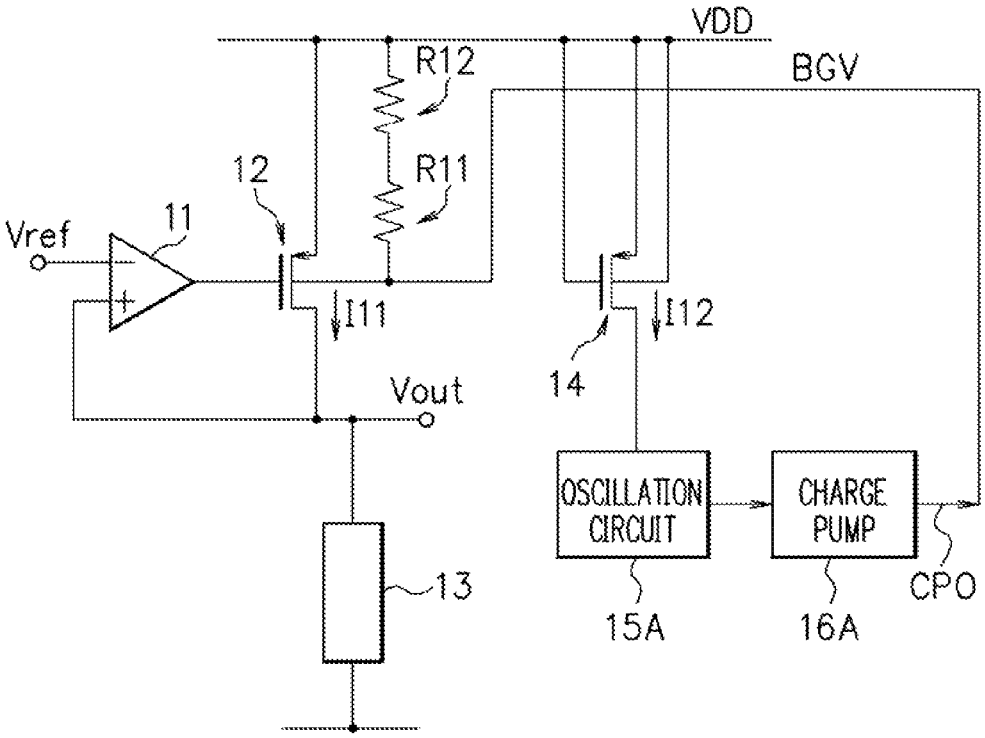
FIG. 1A is a diagram depicting a configuration example of a constant voltage circuit in a first embodiment.
Figure 11:
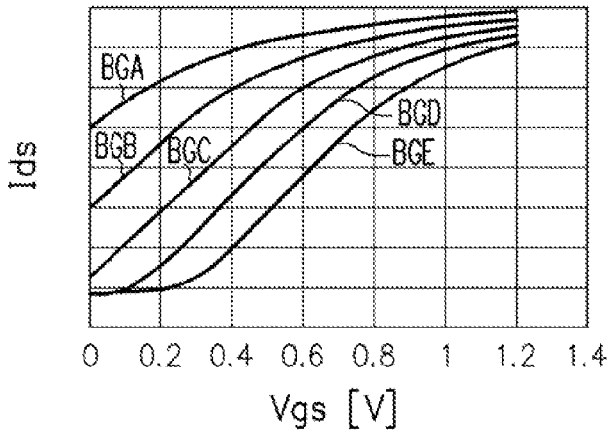
FIG. 11 is a view depicting an example of the Vgs-Ids characteristic of the P-channel transistor.
Figure 12:
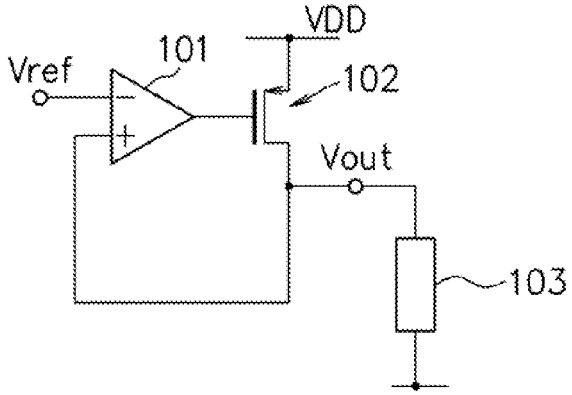
FIG. 12 is a diagram depicting a configuration example of a conventional constant voltage circuit.

FIG. 1A is a diagram depicting a configuration example of a constant voltage circuit in the first embodiment. In FIG. 1A, 11 denotes an error amplifier circuit, 12 denotes an output transistor, 13 denotes a load, 14 denotes a monitoring transistor, 15A denotes an oscillation circuit, 16A denotes a charge pump circuit, and R11 and R12 each denote a resistance.

The error amplifier circuit 11 has an output voltage Vout that is output from an output terminal of the constant voltage circuit input to a positive input end thereof and has a reference voltage Vref that is set beforehand input to a negative input end thereof. The reference voltage Vref is a constant voltage to be supplied from a not-illustrated reference voltage circuit, for example. The error amplifier circuit 11 amplifies a difference voltage between the output voltage Vout and the reference voltage Vref to output an amplified voltage.

As the output transistor 12, for example, a P-channel transistor is used. The output transistor 12 has a power supply voltage VDD supplied to a source thereof and has the output voltage of the error amplifier circuit 11 supplied to a gate thereof. Further, the output transistor 12 has a drain thereof coupled to the output terminal of the constant voltage circuit, and the output voltage Vout is supplied to the load 13 from the output terminal of the constant voltage circuit. That is, an on-resistance of the output transistor 12 changes according to the output voltage of the error amplifier circuit 11 to be supplied to the gate, and the output transistor 12 controls the output voltage Vout. Further, a back gate (that is also referred to as a substrate gate) of the output transistor 12 is coupled to an output of the charge pump circuit 16A and is coupled to the power supply voltage VDD via the resistances R11 and R12 coupled in series.

Figure 10:
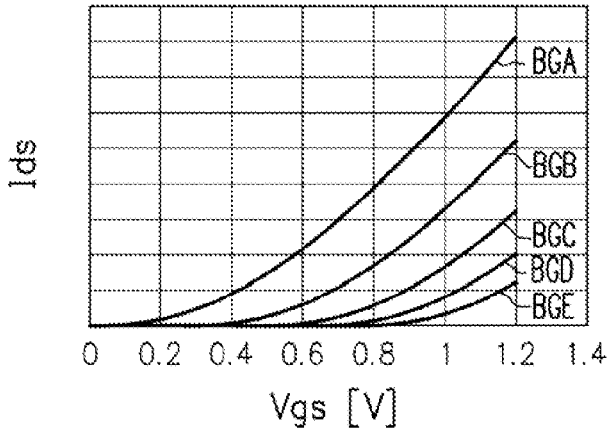
FIG. 10 is a view depicting an example of a Vgs-Ids characteristic of a P-channel transistor.

Here, the P-channel transistor used as the output transistor 12 has a Vgs-Ids characteristic as depicted in FIG. 10 and FIG. 11. In FIG. 10 and FIG. 11, the horizontal axis indicates a voltage Vgs between a gate and a source, and the vertical axis indicates a current Ids flowing between a drain and the source. Note that in FIG. 11, the current Ids is depicted on a logarithmic scale. In FIG. 10 and FIG. 11, BGA, BGB, BGC, BGD, and BGE differ in voltage to be supplied to a back gate, and the voltage to be supplied to the back gate becomes higher in the order of BGA, BGB, BGC, BGD, and BGE. That is, among BGA, BGB, BGC, BGD, and BGE, BGA indicates that the voltage to be supplied to the back gate is the lowest, and BGE indicates that the voltage to be supplied to the back gate is the highest.

It is found from a graph depicted in FIG. 10 that in a state where the load 13 is driven (of, for example, Vgs≥a threshold voltage Vth of the output transistor 12), the voltage to be supplied to the back gate of the transistor is dropped, and thereby the current Ids increases. In other words, in the case when the same drive capability is needed, the voltage to be supplied to the back gate is dropped, thereby making it possible to make the size of the transistor small. Further, it is found from a graph depicted in FIG. 11 that when a current flowing through the load 13 is quite small (Vgs is almost zero), the voltage to be supplied to the back gate of the transistor is raised, and thereby the current Ids becomes small, namely a leakage current reduces.

Returning to FIG. 1A, the monitoring transistor 14 is a transistor for detecting a leakage current. The monitoring transistor 14 and the output transistor 12 are the same type of transistor, and the characteristic of the monitoring transistor 14 and the characteristic of the output transistor 12 correlate to each other. For example, a gate width W/a gate length L of a unit transistor configuring the monitoring transistor 14 and a gate width W/a gate length L of a unit transistor configuring the output transistor 12 are equal. Further, through the monitoring transistor 14, for example, a leakage current having a correlation with a leakage current flowing through the output transistor 12 flows. In this embodiment, as the monitoring transistor 14, the same type of P-channel transistor as that of the output transistor 12, for example, is used. The monitoring transistor 14 has the power supply voltage VDD supplied to a source thereof and a gate thereof, and has a drain thereof coupled to the oscillation circuit 15A. Further, the power supply voltage VDD is supplied to a back gate of the monitoring transistor 14.

The oscillation circuit 15A and the charge pump circuit 16A configure a voltage generation circuit. The voltage generation circuit configured by the oscillation circuit 15A and the charge pump circuit 16A generates a voltage corresponding to a leakage current I12 detected by the monitoring transistor 14 to supply the voltage to the back gate of the output transistor 12 as a back gate voltage BGV.

Figure 2A:
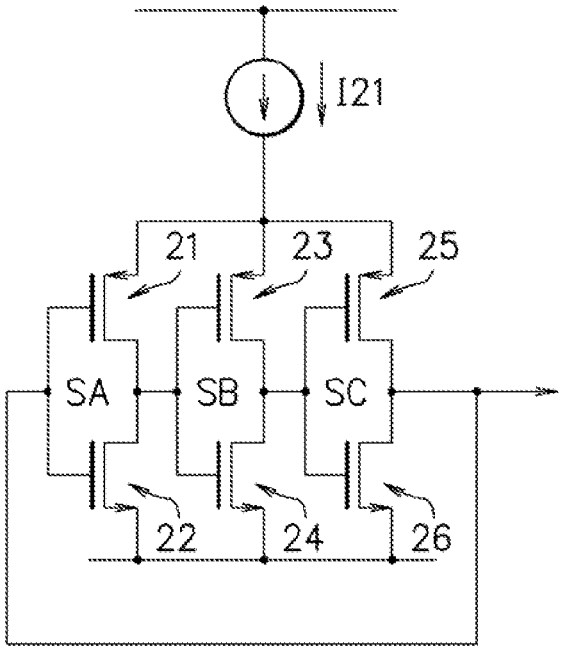
FIG. 2A is a circuit diagram depicting a configuration example of an oscillation circuit in this embodiment.

The oscillation circuit 15A has the leakage current I12 flowing through the monitoring transistor 14 supplied thereto. When the current I12 to be supplied exceeds a threshold value, the oscillation circuit 15A operates to output an oscillation signal having an oscillation frequency proportional to the current I12. A configuration example of a ring oscillator applicable as the oscillation circuit 15A is depicted in FIG. 2A. The ring oscillator depicted in FIG. 2A has P-channel transistors 21, 23, and 25 and N-channel transistors 22, 24, and 26, and outputs an oscillation signal having an oscillation frequency corresponding to the current I21 that corresponds to an input current.

Figure 2B:
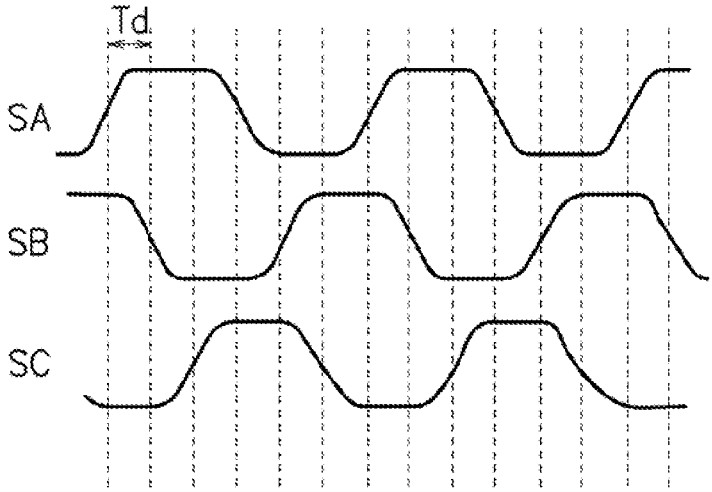
FIG. 2B is a view depicting an example of an oscillation signal that the oscillation circuit depicted in FIG. 2A outputs.

FIG. 2A depicts the ring oscillator having a first inverter having the transistors 21 and 22, a second inverter having the transistors 23 and 24, and a third inverter having the transistors 25 and 26 as one example. The ring oscillator depicted in FIG. 2A, when a delay time of each of the inverters is set to Td, outputs an oscillation signal that oscillates with a period of the delay time Td×6 as depicted in FIG. 2B. In FIG. 2B, it is set that SA indicates an input of the first inverter, SB indicates an input of the second inverter, and SC indicates an input of the third inverter. Here, the delay time Td of each of the inverters is inversely proportional to mutual conductance gm of the transistor and is proportional to gate capacitance. Further, the mutual conductance gm of the transistor is proportional to the square root of a current value to flow. Thus, the ring oscillator depicted in FIG. 2A outputs an oscillation signal having an oscillation frequency corresponding to a current value I21.

Figure 3A:
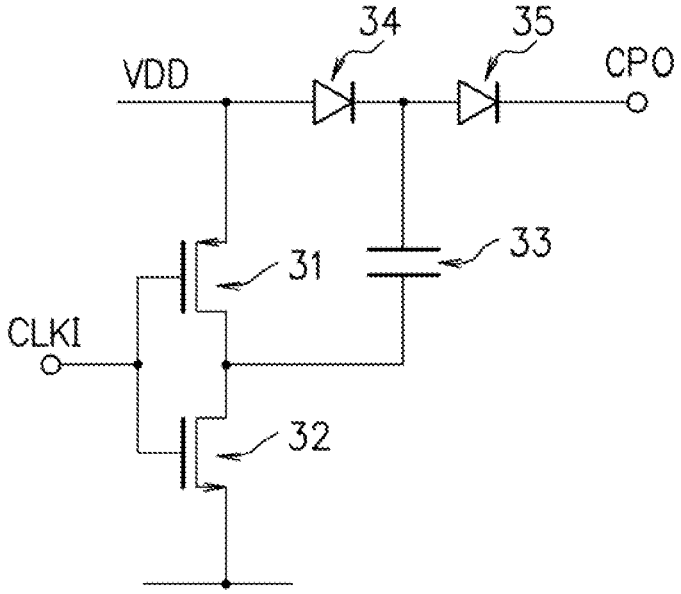
FIG. 3A is a circuit diagram depicting a configuration example of a charge pump circuit in this embodiment.

The charge pump circuit 16A receives the oscillation signal output from the oscillation circuit 15A as an input clock and outputs a voltage corresponding to the input clock as an output CPO. FIG. 3A is a circuit diagram depicting a configuration example of the charge pump circuit 16A. The charge pump circuit 16A depicted in FIG. 3A has a P-channel transistor 31, an N-channel transistor 32, a capacitance 33, and diodes 34 and 35. An inverter having the transistors 31 and 32 operates with the power supply voltage VDD to have an input clock CLKI input thereto and have an output thereof coupled to one electrode of the capacitance 33. The other electrode of the capacitance 33 is coupled to a coupling node between a cathode of the diode 34 and an anode of the diode 35. Further, an anode of the diode 34 is coupled to the power supply voltage VDD and a cathode of the diode 35 is coupled to an output end from which the output CPO is output.

Figure 3B:
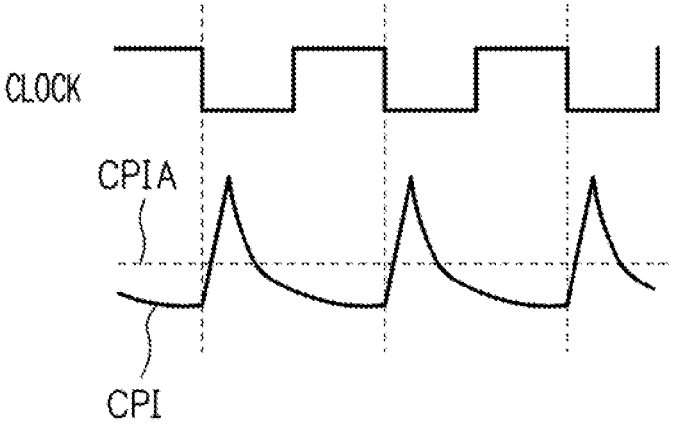
FIG. 3B is a view depicting an example of an input clock and an output current in the charge pump circuit depicted in FIG. 3A.

When a clock as depicted in FIG. 3B is input to the charge pump circuit depicted in FIG. 3A as the input clock CLKI, an output current as depicted by CPI flows. Note that in FIG. 3B, CPIA indicates an average of the output current CPI. Here, the output voltage as the output CPO of the charge pump circuit 16A is obtained by multiplying a load of an output terminal of the charge pump circuit and the output current (average) CPIA together. Incidentally, the upper limit of the output voltage of the charge pump circuit depicted in FIG. 3A is limited by (the power supply voltage VDD×2−a forward drop voltage of the diode×2). Further, the output current (average) CPIA is proportional to the frequency of the clock (oscillation signal) to be input as the input clock CLKI.

That is, as long as the load of the output terminal of the charge pump circuit is set constant, the output CPO of the charge pump circuit 16A is proportional to the oscillation frequency of the oscillation signal to be input from the oscillation circuit 15A. As described previously, the oscillation frequency of the oscillation signal from the oscillation circuit 15A is proportional to the leakage current I12 detected by the monitoring transistor 14. Thus, the output CPO of the charge pump circuit 16A is a voltage proportional to the leakage current I12 detected by the monitoring transistor 14, and the voltage is supplied to the back gate of the output transistor 12 as the back gate voltage BGV.

Incidentally, the circuit configurations depicted in FIG. 2A and FIG. 3A each are one example, and the configurations of the oscillation circuit and the charge pump circuit in each of the embodiments including other embodiments to be explained below are not limited to the circuit configurations depicted in FIG. 2A and FIG. 3A.

Next, the operation of the constant voltage circuit in the first embodiment will be explained.

The basic operation of the constant voltage circuit in the first embodiment depicted in FIG. 1A is similar to that of a conventional constant voltage circuit. That is, when the output voltage Vout becomes lower than the reference voltage Vref, the output voltage of the error amplifier circuit 11, namely the voltage to be supplied to the gate of the output transistor 12 drops. As a result, the on resistance of the output transistor 12 reduces and the output voltage Vout rises. Conversely, when the output voltage Vout becomes higher than the reference voltage Vref, the output voltage of the error amplifier circuit 11 rises. As a result, the on resistance of the output transistor 12 increases and the output voltage Vout drops. In this manner, the output voltage Vout to be output from the output terminal of the constant voltage circuit is maintained to the reference voltage Vref being a constant voltage.

Next, the control of the voltage to be supplied to the back gate of the output transistor 12 will be explained.

Figure 1B:
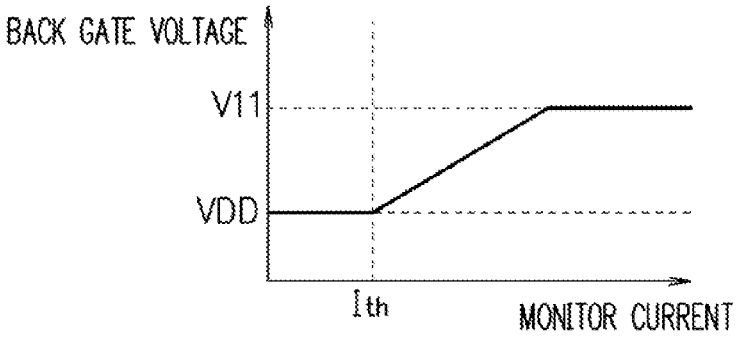
FIG. 1B is a view depicting one example of a back gate voltage to be supplied to an output transistor in the first embodiment.

When a monitor current being the leakage current I12 detected by the monitoring transistor 14 is small, (which is zero or almost zero, for example), the oscillation circuit 15A does not operate but halts. Thus, as depicted in FIG. 1B, the voltage to be supplied to the back gate of the output transistor 12 becomes the power supply voltage VDD.

In the case when temperature changes (rises high) or the like and thereby the leakage current I12 detected by the monitoring transistor 14 becomes larger than a threshold value Ith, the oscillation circuit 15A operates to output an oscillation signal having an oscillation frequency corresponding to the leakage current I12. Thereby, the charge pump circuit 16A outputs the output CPO proportional to the oscillation frequency of the oscillation signal output from the oscillation circuit 15A, and the output CPO is supplied to the back gate of the output transistor 12 as the back gate voltage BGV. That is, as depicted in FIG. 1B, when the leakage current I12 detected by the monitoring transistor 14 is larger than the threshold value Ith, the voltage that is the voltage equal to or higher than the power supply voltage VDD and is proportional to the leakage current I12 is supplied to the back gate of the output transistor 12. In this manner, the voltage to be supplied to the back gate of the output transistor 12 is controlled to increase proportionally to the leakage current I12 detected by the monitoring transistor 14, thereby making it possible to reduce the leakage current of the output transistor 12. Incidentally, in FIG. 1B, V11 is an upper limit value of a voltage determined according to the configuration of the charge pump circuit 16A.

As above, according to the first embodiment, the voltage proportional to the leakage current I12 detected by the monitoring transistor 14 is generated to be supplied to the back gate of the output transistor 12. This makes it possible to linearly change and control the voltage to be supplied to the back gate of the output transistor 12 and to reduce the leakage current of the output transistor 12 while suppressing a fluctuation in the output voltage. For example, even under the operation condition such that the leakage current of the output transistor 12 increases such as at the time of high temperature, it is possible to reduce the leakage current and suppress the rise in the output voltage Vout. Further, the reduction in the leakage current makes it possible to reduce a current to be consumed.

Further, the voltage to be supplied to the back gate of the output transistor 12 is changed linearly, so that it is possible to prevent the voltage to be supplied to the back gate of the output transistor 12 from fluctuating rapidly even though the output voltage Vout rapidly fluctuates tentatively.

Figure 4:
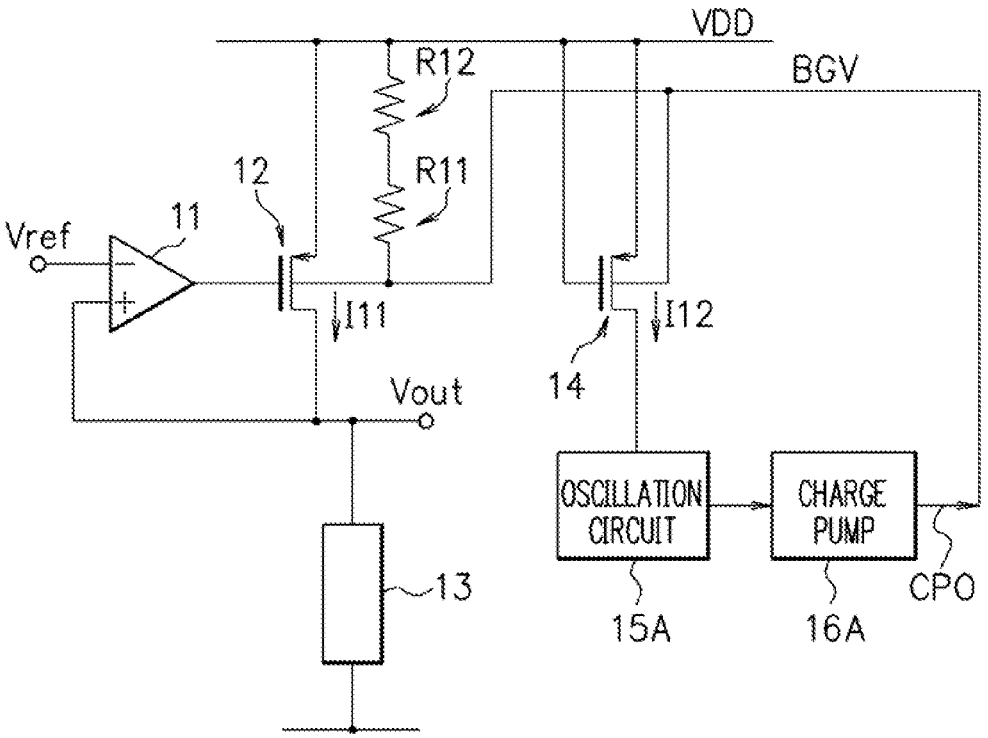
FIG. 4 is a diagram depicting another configuration example of the constant voltage circuit in the first embodiment.

Incidentally, in the example depicted in FIG. 1A, the power supply voltage VDD is designed to be supplied to the back gate of the monitoring transistor 14, but as depicted in FIG. 4, it may also be designed that the output CPO of the charge pump circuit 16A is supplied to the back gate of the monitoring transistor 14 as the back gate voltage. FIG. 4 is a diagram depicting another configuration example of the constant voltage circuit in the first embodiment. In FIG. 4, components having the same functions as those of the components depicted in FIG. 1A are denoted by the same reference numerals and symbols to thereby omit repeated explanation. In the case when it is configured as depicted in FIG. 4, a negative feedback is applied to the back gate voltage BGV, and thereby it is possible to limit a voltage range where the back gate voltage BGV, namely the output CPO of the charge pump circuit 16A can fluctuate.

(Second Embodiment)

Next, a second embodiment will be explained.

Figure 5A:
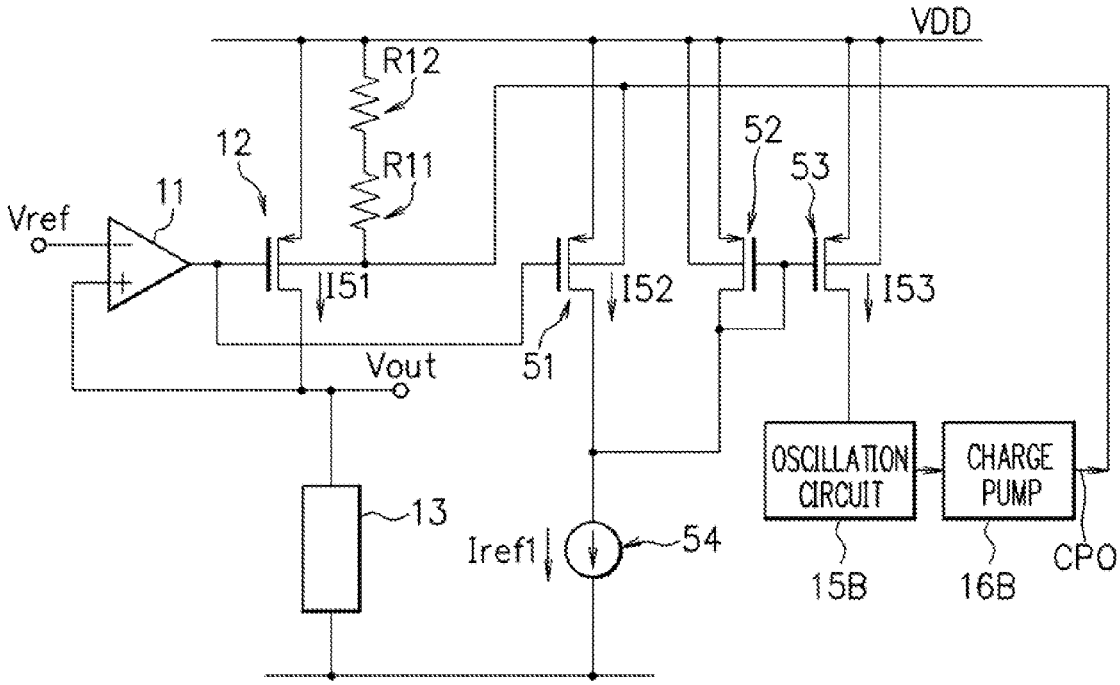
FIG. 5A is a diagram depicting a configuration example of a constant voltage circuit in a second embodiment.

FIG. 5A is a diagram depicting a configuration example of a constant voltage circuit in the second embodiment. In FIG. 5A, components having the same functions as those of the components depicted in FIG. 1A are denoted by the same reference numerals and symbols. In FIG. 5A, 51 denotes a monitoring transistor, 52 and 53 each denote a transistor, 54 denotes a constant current source, 15B denotes an oscillation circuit, and 16B denotes a charge pump circuit.

The monitoring transistor 51 is a transistor for detecting a drive current I51 of an output transistor 12. The monitoring transistor 51 and the output transistor 12 are the same type of transistor, and the characteristic of the monitoring transistor 51 and the characteristic of the output transistor 12 correlate to each other. For example, a gate width W/a gate length L of a unit transistor configuring the monitoring transistor 51 and a gate width W/a gate length L of a unit transistor configuring the output transistor 12 are equal. Further, through the monitoring transistor 51, for example, a drive current I52 having a correlation with the drive current I51 of the output transistor 12 flows.

In this embodiment, as the monitoring transistor 51, the same type of P-channel transistor as that of the output transistor 12, for example, is used, and similarly to the output transistor 12, the monitoring transistor 51 is controlled by an output voltage of an error amplifier circuit 11. The monitoring transistor 51 has a power supply voltage VDD supplied to a source thereof and has the output voltage of the error amplifier circuit 11 supplied to a gate thereof, and has a drain thereof coupled to the constant current source 54. Further, a back gate of the monitoring transistor 51 is coupled to an output of the charge pump circuit 16B and is coupled to the power supply voltage VDD via resistances R11 and R12 coupled in series.

The transistors 52 and 53 each are a P-channel transistor, for example. The power supply voltage VDD is supplied to sources of the transistors 52 and 53. A gate of the transistor 52 and a gate of the transistor 53 are coupled, and a coupling node therebetween is coupled to a drain of the transistor 52. That is, the transistors 52 and 53 are coupled in a current-mirror manner. Further, the drain of the transistor 52 is coupled to a coupling node between the drain of the monitoring transistor 51 and the constant current source 54, and a drain of the transistor 53 is coupled to the oscillation circuit 15B. Further, the power supply voltage VDD is supplied to back gates of the transistors 52 and 53.

The oscillation circuit 15B and the charge pump circuit 16B configure a voltage generation circuit. The oscillation circuit 15B, similarly to the oscillation circuit 15A in the first embodiment, outputs an oscillation signal having an oscillation frequency corresponding to a current to be input. Further, the charge pump circuit 16B, similarly to the charge pump circuit 16A in the first embodiment, receives the oscillation signal output from the oscillation circuit 15B as an input clock to output a voltage corresponding to the input clock as an output CPO. The oscillation circuit 15B is configured as depicted in FIG. 2A, for example and the charge pump circuit 16B is configured as depicted in FIG. 3A, for example.

Next, the operation of the constant voltage circuit in the second embodiment will be explained. Incidentally, the basic operation of the constant voltage circuit in the second embodiment is similar to that of a conventional constant voltage circuit, so that the explanation is omitted, and hereinafter, the control of a voltage to be supplied to a back gate of the output transistor 12 will be explained. In the constant voltage circuit in the second embodiment, the current I52 flowing through the monitoring transistor 51 and Iref1 being a current value of the constant current source 54 are compared, and based on a comparison result, the voltage to be supplied to the back gate of the output transistor 12 is controlled. The current value Iref1 is a current value corresponding to a boundary level of which whether or not an output voltage Vout rises by a current flowing through the output transistor 12. In the case when a current flowing through a load 13 is small and the output voltage Vout rises by the current I51 flowing through the output transistor 12, the current I52<the current value Iref1 is established, and to the contrary, the current value Iref1<the current I52 is established.

Figure 5B:
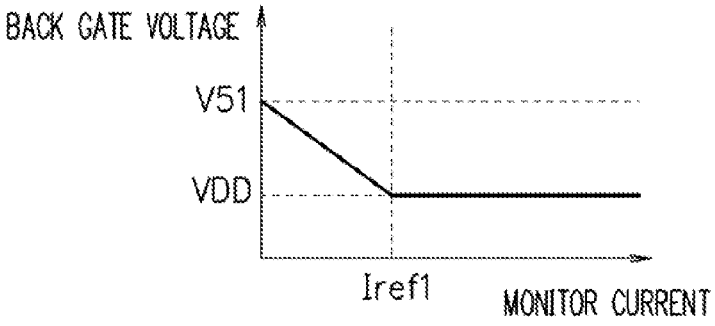
FIG. 5B is a view depicting an example of a back gate voltage to be supplied to an output transistor in the second embodiment.

When the load 13 is a light load and the current I52<the current value Iref1 is established, a current I53 proportional to (Iref1−I52) flows through the transistor 53, and the oscillation circuit 15B operates to output an oscillation signal having an oscillation frequency corresponding to the current I53. Thereby, the charge pump circuit 16B outputs an output voltage CPO proportional to the oscillation frequency of the oscillation signal output from the oscillation circuit 15B, and the output voltage CPO is supplied to the back gates of the output transistor 12 and the monitoring transistor 51 as a back gate voltage BGV. That is, as depicted in FIG. 5B, in the case of I52<Iref1, the voltage that is the voltage equal to or higher than the power supply voltage VDD and is proportional to the current I52, namely the drive current I51 of the output transistor 12 is supplied to the back gate of the output transistor 12. In this manner, the voltage to be supplied to the back gate of the output transistor 12 is controlled proportionally to the drive current I51 so as to become larger as the drive current I51 becomes smaller, and thereby it is possible to reduce a leakage current of the output transistor 12 in a state where the current flowing through the load 13 is small. Incidentally, in FIG. 5B, V51 is an upper limit value of a voltage determined according to the configuration of the charge pump circuit 16B.

On the other hand, when the load 13 is sufficiently large and the current value Iref1<the current I52 is established, the current I53 does not flow through the transistor 53, (which is zero), and the oscillation circuit 15B does not operate but halts. Thus, as depicted in FIG. 5B, the voltage to be supplied to the back gate of the transistor 12 becomes the power supply voltage VDD.

According to the second embodiment, in the case when the current flowing through the load 13 is smaller than a threshold value, the voltage proportional to the drive current I51 of the output transistor 12 is generated to be output to the back gate of the output transistor 12. This makes it possible to linearly change and control the voltage to be supplied to the back gate of the output transistor 12 and to reduce the leakage current of the output transistor 12 while suppressing a fluctuation in the output voltage. Further, even under the operation condition such that the leakage current of the transistor increases such as at the time of high temperature, it is possible to reduce the leakage current and further to reduce a current to be consumed.

(Third Embodiment)

Next, a third embodiment will be explained.

Figure 6A:
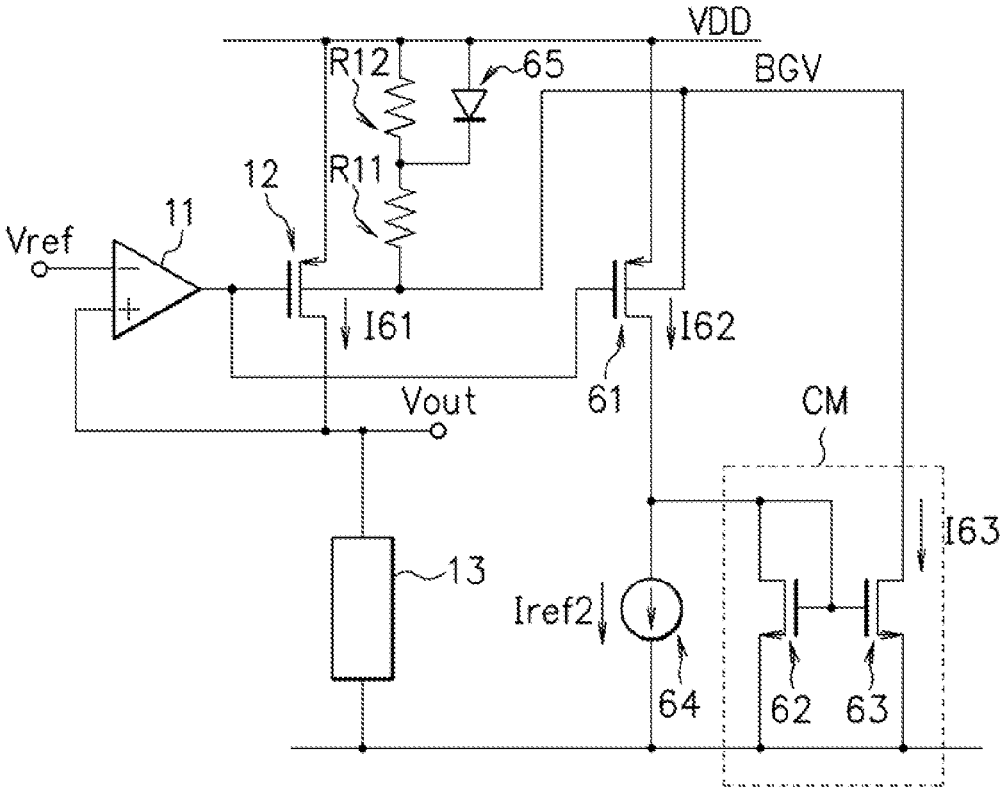
FIG. 6A is a diagram depicting a configuration example of a constant voltage circuit in a third embodiment.

FIG. 6A is a diagram depicting a configuration example of a constant voltage circuit in the third embodiment. In FIG. 6A, components having the same functions as those of the components depicted in FIG. 1A are denoted by the same reference numerals and symbols. In FIG. 6A, 61 denotes a monitoring transistor, 64 denotes a constant current source, 65 denotes a diode, and CM denotes a current mirror circuit.

The monitoring transistor 61 is a transistor for detecting a drive current I61 of an output transistor 12. The monitoring transistor 61 and the output transistor 12 are the same type of transistor, and the characteristic of the monitoring transistor 61 and the characteristic of the output transistor 12 correlate to each other. For example, a gate width W/a gate length L of a unit transistor configuring the monitoring transistor 61 and a gate width W/a gate length L of a unit transistor configuring the output transistor 12 are equal. Further, for example, through the monitoring transistor 61, a drive current I62 having a correlation with the drive current I61 of the output transistor 12 flows.

As the monitoring transistor 61, the same type of P-channel transistor as that of the output transistor 12, for example, is used, and similarly to the output transistor 12, the monitoring transistor 61 is controlled by an output voltage of an error amplifier circuit 11. The monitoring transistor 61 has a power supply voltage VDD supplied to a source thereof and has the output voltage of the error amplifier circuit 11 supplied to a gate thereof, and has a drain thereof coupled to the constant current source 64. Further, a back gate of the monitoring transistor 61 is coupled to a supply line of a back gate voltage BGV and is coupled to the power supply voltage VDD via resistances R11 and R12 coupled in series.

The current mirror circuit CM has N-channel transistors 62 and 63. Sources of the N-channel transistors 62 and 63 are coupled to a reference potential. A gate of the N-channel transistor 62 and a gate of the N-channel transistor 63 are coupled, and a coupling node therebetween is coupled to a drain of the N-channel transistor 62. That is, the N-channel transistors 62 and 63 are coupled in a current-mirror manner. Further, the drain of the N-channel transistor 62 is coupled to a coupling node between the drain of the monitoring transistor 61 and the constant current source 64, and a drain of the N-channel transistor 63 is coupled to the supply line of the back gate voltage BGV.

The diode 65 is to clip a potential of the supply line of the back gate voltage BGV to a certain potential so as not to make the potential of the supply line of the back gate voltage BGV drop too much in order to prevent a current from flowing backward between a drain and a back gate of the output transistor 12. The diode 65 has an anode thereof coupled to the power supply voltage VDD, and has a cathode thereof coupled to a coupling node between the resistances R11 and R12.

Next, the operation of the constant voltage circuit in the third embodiment will be explained. Incidentally, the basic operation of the constant voltage circuit in the third embodiment is similar to that of a conventional constant voltage circuit, so that the explanation is omitted, and hereinafter, the control of a voltage to be supplied to the back gate of the output transistor 12 will be explained. In the constant voltage circuit in the third embodiment, the current I62 flowing through the monitoring transistor 61 and Iref2 being a current value of the constant current source 64 are compared, and based on a comparison result, the voltage to be supplied to the back gate of the output transistor 12 is controlled. The current value Iref2 is a current value within a range where a current value corresponding to a lower limit of which the current mirror circuit CM operates stably is set to be minimum and a current value corresponding to a current immediately before drive capability of the output transistor 12 is saturated is set to be maximum. Incidentally, that the current mirror circuit CM operates stably indicates that when a current value I62 flowing through the monitoring transistor 61 is zero, a gate voltage of the transistors 62 and 63 does not become inconstant.

Figure 6B:
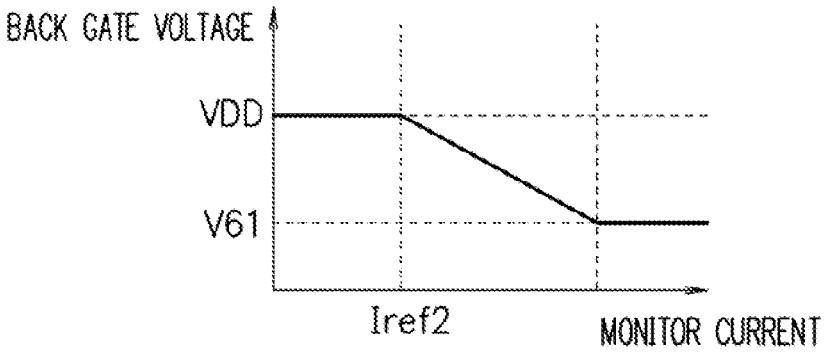
FIG. 6B is a view depicting an example of a back gate voltage to be supplied to an output transistor in the third embodiment.

When the drive current I61 of the output transistor 12 is small and the current I62 flowing through the monitoring transistor 61 is smaller than the current value Iref2, a current I63 does not flow through the transistor 63 in the current mirror circuit CM, (which is zero). Thus, the potential of the supply line of the back gate voltage BGV does not change, and as depicted in FIG. 6B, the voltage to be supplied to the back gate of the output transistor 12 becomes the power supply voltage VDD.

Further, when the drive current I62 of the output transistor 12 is large and the current I62 flowing through the monitoring transistor 61 is larger than the current value Iref2, the current I63 proportional to (I62−Iref2) flows through the transistor 63 in the current mirror circuit CM. Thereby, the potential of the supply line of the back gate voltage BGV drops, and the voltage to be supplied to the back gate of the output transistor 12, as depicted in FIG. 6B, drops to the voltage equal to or lower than the power supply voltage VDD with the increase in the current I62. That is, in the case of Iref2<I62, the voltage that is the voltage equal to or lower than the power supply voltage VDD and is dropped proportionally to the current I62, namely the drive current I61 of the output transistor 12 is supplied to the back gate of the output transistor 12. Incidentally, in FIG. 6B, V61 is a lower limit value of a voltage determined by a clip method in the circuit.

According to the third embodiment, in the case when the current I62 flowing through the monitoring transistor 61 is larger than a threshold value, the voltage to be supplied to the back gate of the output transistor 12 is controlled proportionally to the current I62, namely the drive current I61 of the output transistor 12 so as to become smaller as the drive current I61 becomes larger. This makes it possible to reduce an on-resistance of the output transistor 12 to thereby increase the drive capability (current supply capability) while suppressing a fluctuation in the output voltage. Thus, even though the size of the output transistor 12 is made small, by controlling the voltage to be supplied to the back gate, the desired drive capability (current supply capability) can be obtained, and it is possible to make the size of the output transistor 12 small to thereby reduce a circuit area. Further, the size of the output transistor 12 can be made small, thereby making it possible to reduce a leakage current.

(Fourth Embodiment)

Figure 7A:
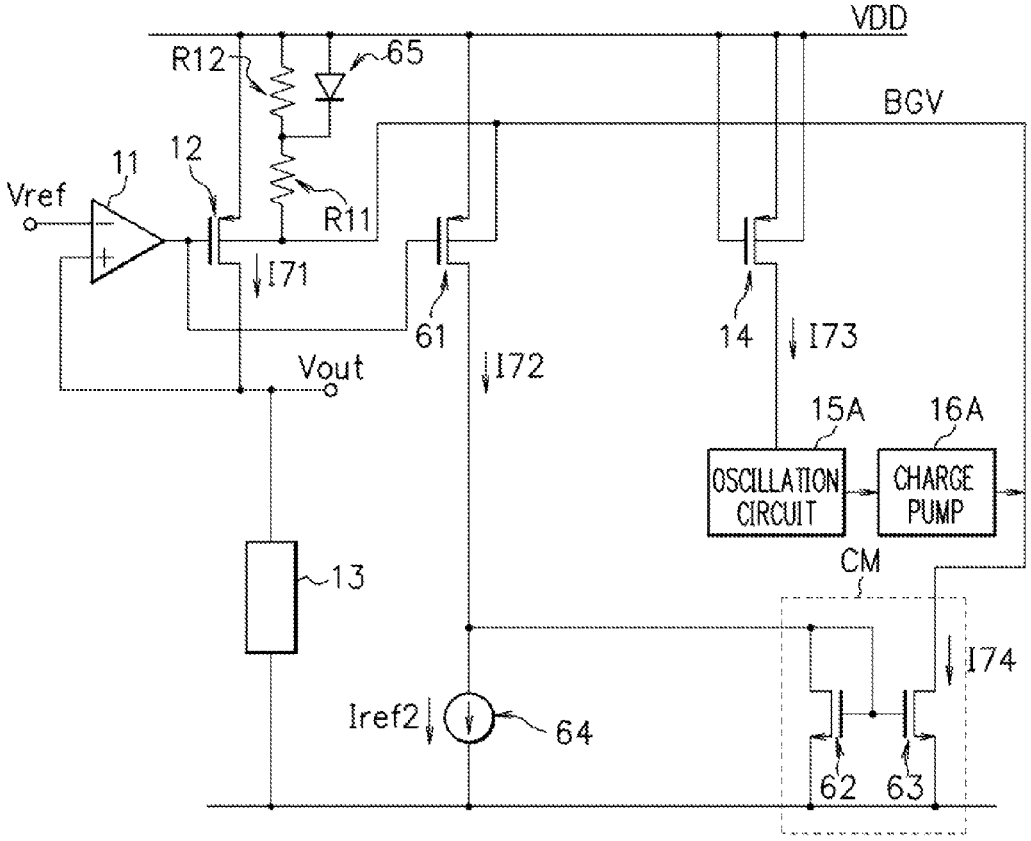
FIG. 7A is a diagram depicting a configuration example of a constant voltage circuit in a fourth embodiment.

Next, a fourth embodiment will be explained. A constant voltage circuit in the fourth embodiment is provided with the functions of the constant voltage circuits in the above-described first embodiment and third embodiment. FIG. 7A is a diagram depicting a configuration example of the constant voltage circuit in the fourth embodiment. In FIG. 7A, components having the same functions as those of the components depicted in FIG. 1A and FIG. 6A are denoted by the same reference numerals and symbols to thereby omit repeated explanation.

In the constant voltage circuit in the fourth embodiment, based on a result of which a leakage current I73 detected by a monitoring transistor 14 and a current I72 flowing through a monitoring transistor 61 are compared with a current value Iref2, a back gate voltage of an output transistor 12 is controlled. The current value Iref2 is a current value within a range where a large current value out of an off leakage current of the output transistor 12 and a current corresponding to a lower limit of which a current mirror circuit CM operates stably is set to be minimum and a current value corresponding to a current immediately before drive capability of the output transistor 12 is saturated is set to be maximum.

Figure 7B:
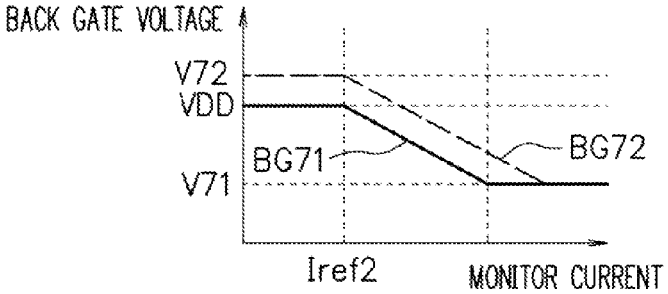
FIG. 7B is a view depicting an example of a back gate voltage to be supplied to an output transistor in the fourth embodiment.

When a leakage current is not generated in the output transistor 12, or is quite small (the current I73<Ith), similarly to the above-described third embodiment, the voltage to be supplied to a back gate of the output transistor 12 is controlled as indicated by BG71 in FIG. 7B. That is, the voltage to be supplied to the back gate of the output transistor 12 is controlled according to the current I72 flowing through the monitoring transistor 61, and in the case of I72<Iref2, the voltage to be supplied to the back gate of the output transistor 12 becomes a power supply voltage VDD. Further, in the case of Iref2<I72, a current I74 flows through the current mirror circuit CM and thereby the voltage dropped proportionally to the current I72, namely a drive current I71 of the output transistor 12 from the power supply voltage VDD is supplied to the back gate of the output transistor 12. Incidentally, in FIG. 7B, V71 is a lower limit value of a voltage determined by a clip method in the circuit.

On the other hand, when a leakage current is generated in the output transistor 12 (the current I73>Ith), similarly to the above-described first embodiment, the voltage corresponding to the generated leakage current is supplied to the back gate of the output transistor 12. That is, the voltage proportional to the leakage current I73 detected by the monitoring transistor 14 is generated in an oscillation circuit 15A and a charge pump circuit 16A to be supplied to the back gate of the output transistor 12. Here, in the case of I72<Iref2, the voltage to be supplied to the back gate of the output transistor 12 according to the leakage current of the transistor is set to V72 (>the power supply voltage VDD). Incidentally, the upper limit of the voltage V72 is determined according to the configuration of the charge pump circuit 16A. Further, similarly to the above-described third embodiment, the voltage to be supplied to the back gate of the output transistor 12 is controlled according to the current I72 flowing through the monitoring transistor 61 and is controlled as indicated by BG72 in FIG. 7B. That is, in the case of I72<Iref2, the voltage to be supplied to the back gate of the output transistor 12 becomes the voltage V72. Further, in the case of Iref2<I72, the current I74 flows through the current mirror circuit CM and thereby the voltage dropped proportionally to the current I72, namely the drive current I71 from the voltage V72 is supplied to the back gate of the output transistor 12.

According to the fourth embodiment, an effect similar to that of the first embodiment and the third embodiment is obtained. That is, it is possible to linearly change and control the voltage to be supplied to the back gate of the output transistor 12 according to the leakage current I73 detected by the monitoring transistor 14 and to reduce the leakage current of the output transistor 12 while suppressing a fluctuation in the output voltage. For example, even under the operation condition such that the leakage current of the output transistor 12 increases, it is possible to reduce the leakage current and suppress a rise in an output voltage Vout. Further, according to the current I72 flowing through the monitoring transistor 61, the voltage to be supplied to the back gate of the output transistor 12 is controlled proportionally to the current I72, and thereby it is possible to increase the drive capability of the output transistor 12 while suppressing a fluctuation in the output voltage. This makes it possible to make the size of the output transistor 12 small, reduce the leakage current, and reduce a circuit area. Further, the reduction in the leakage current makes it possible to reduce a current to be consumed.

(Fifth Embodiment)

Figure 8A:
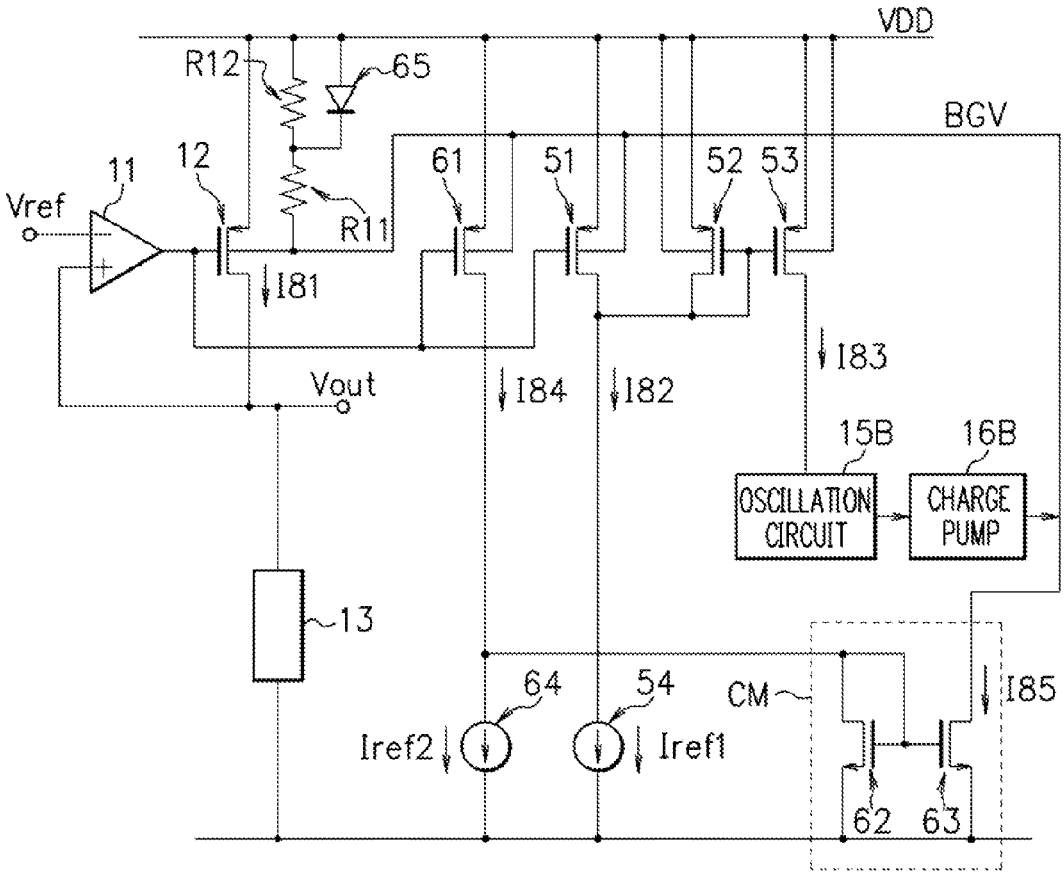
FIG. 8A is a diagram depicting a configuration example of a constant voltage circuit in a fifth embodiment.

Next, a fifth embodiment will be explained. A constant voltage circuit in the fifth embodiment is provided with the functions of the constant voltage circuits in the above-described second embodiment and third embodiment. FIG. 8A is a diagram depicting a configuration example of the constant voltage circuit in the fifth embodiment. In FIG. 8A, components having the same functions as those of the components depicted in FIG. 1A, FIG. 5A, and FIG. 6A are denoted by the same reference numerals and symbols to thereby omit repeated explanation.

In the constant voltage circuit in the fifth embodiment, based on a result of a current I82 flowing through a monitoring transistor 51 and a current value Iref1 being compared and a result of a current I84 flowing through a monitoring transistor 61 and a current value Iref2 being compared, a back gate voltage of an output transistor 12 is controlled. The current values Iref1 and Iref2 are arbitrary current values satisfying the relationship of Iref1<Iref2. However, a minimum value capable of being set as the current value Iref1 is a current value corresponding to a lower limit of which a current mirror circuit CM operates stably, and a maximum value capable of being set as the current value Iref2 is a current value corresponding to a current immediately before drive capability of the output transistor 12 is saturated.

Figure 8B:
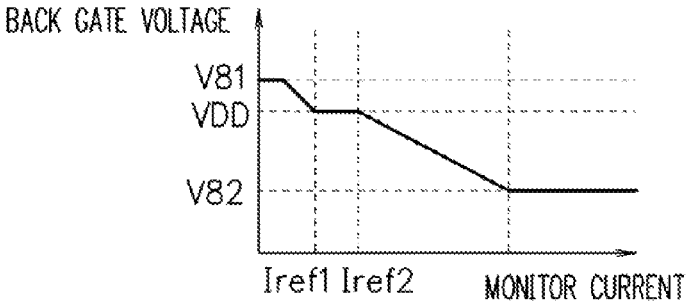
FIG. 8B is a view depicting an example of a back gate voltage to be supplied to an output transistor in the fifth embodiment.

When the current I82 flowing through the monitoring transistor 51 is smaller than the current value Iref1, a circuit corresponding to the above-described second embodiment operates and a circuit corresponding to the third embodiment does not operate but halts. That is, by a circuit including transistors 51 to 53, a constant current source 54, an oscillation circuit 15B, and a charge pump circuit 16B, being the circuit corresponding to the second embodiment, the voltage to be supplied to a back gate of the output transistor 12 is controlled. That is, in the case of I82<Iref1, as depicted in FIG. 8B, the voltage to be supplied to the back gate of the output transistor 12 is controlled proportionally to the current I82, namely a drive current I81 of the output transistor 12 so as to become larger as the drive current I81 becomes smaller. Incidentally, in FIG. 8B, V81 is an upper limit value of a voltage determined according to the configuration of the charge pump circuit 16B.

When the current I82 flowing through the monitoring transistor 51 is larger than the current value Iref1 and the current I84 flowing through the monitoring transistor 61 is smaller than the current value Iref2, the circuits corresponding to the second embodiment and the third embodiment respectively do not operate but halt. At this time, as depicted in FIG. 8B, the voltage to be supplied to the back gate of the output transistor 12 becomes a power supply voltage VDD.

When the current I84 flowing through the monitoring transistor 61 is larger than the current value Iref2, the circuit corresponding to the above-described second embodiment does not operate but halts and the circuit corresponding to the third embodiment operates. That is, by a circuit including a monitoring transistor 61, a constant current source 64, and a current mirror CM, being the circuit corresponding to the third embodiment, the voltage to be supplied to the back gate of the output transistor 12 is controlled. That is, in the case of Iref2<I84, a current I85 flows through the current mirror circuit CM, and thereby as depicted in FIG. 8B, the voltage to be supplied to the back gate of the output transistor 12 is controlled. The voltage to be supplied to the back gate of the output transistor 12 is controlled proportionally to the current I84, namely the drive current I81 of the output transistor 12 so as to become smaller as the drive current I81 becomes larger. Incidentally, in FIG. 8B, V82 is a lower limit value of a voltage determined by a clip method in the circuit.

According to the fifth embodiment, an effect similar to that of the second embodiment and the third embodiment is obtained. That is, it is possible to linearly change and control the voltage to be supplied to the back gate of the output transistor 12 according to the current I82 flowing through the monitoring transistor 51 and to reduce a leakage current of the output transistor 12 while suppressing a fluctuation in the output voltage. Further, according to the current I84 flowing through the monitoring transistor 61, the voltage to be supplied to the back gate of the output transistor 12 is controlled proportionally to the current I84, and thereby it is possible to increase the drive capability of the output transistor 12 while suppressing a fluctuation in the output voltage. This makes it possible to make the size of the output transistor 12 small, reduce the leakage current, and reduce a circuit area. Further, the reduction in the leakage current makes it possible to reduce a current to be consumed.

Figure 9A:
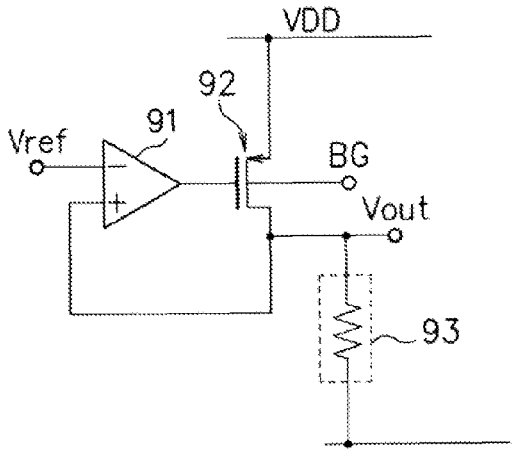
FIG. 9A is a diagram depicting a configuration example of a constant voltage circuit in this embodiment.

FIG. 9B to FIG. 9E are views each depicting a waveform example at the time of controlling a back gate voltage in this embodiment. In a constant voltage circuit depicted in FIG. 9A, a simulation waveform example when a voltage to be supplied to a back gate of an output transistor is controlled is depicted in FIG. 9B to FIG. 9E. In FIG. 9A, 91 denotes an error amplifier circuit, 92 denotes an output transistor, and 93 denotes a load, and further VDD denotes a power supply voltage, Vref denotes a reference voltage, Vout denotes an output voltage, and BG denotes a back gate voltage.

Figure 9B:
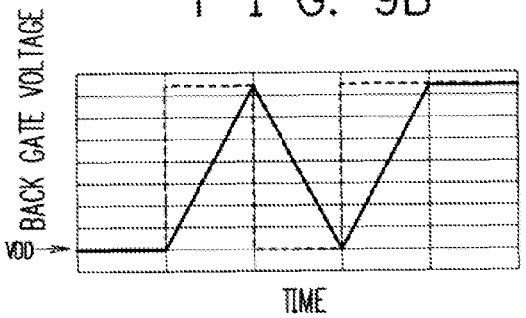
FIG. 9B to FIG. 9E are views each depicting a waveform example at the time of controlling a back gate voltage in the constant voltage circuit depicted in FIG. 9A.
Figure 9C:
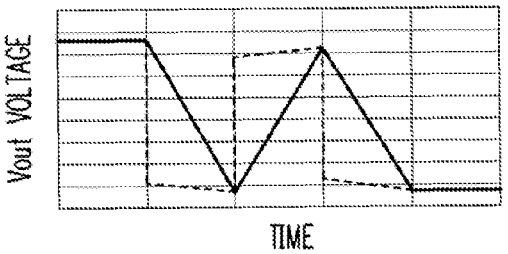
Figure 9D:
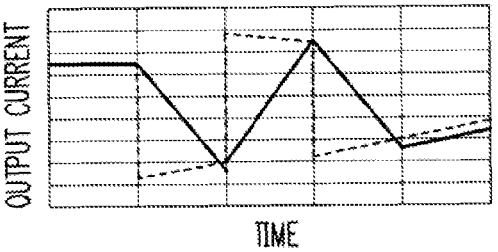
Figure 9E:
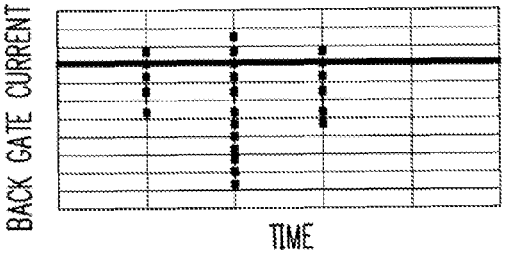

The back gate voltage to be supplied to the back gate of the output transistor is depicted in FIG. 9B, and the output voltage Vout to be output from an output terminal is depicted in FIG. 9C. Further, a current flowing between a drain and a source of the output transistor is depicted in FIG. 9D, and a back gate current flowing through the back gate of the output transistor is depicted in FIG. 9E. Incidentally, in FIG. 9B to FIG. 9E, the simulation waveform example in this example is indicated by a solid line, and for comparison reference, a simulation waveform example at the time when the back gate voltage is controlled by a conventional switch is depicted by a dotted line together.

When the back gate voltage of the output transistor is switched by the switch as in a conventional technique, the output voltage Vout is switched rapidly. At this time, a fluctuation in the current flowing between the drain and the source of the output transistor is also rapid and the back gate current also fluctuates greatly.

In contrast to it, in this embodiment, the back gate voltage of the output transistor changes linearly, so that the output voltage Vout is switched gently. Further, the fluctuation in the current flowing between the drain and the source of the output transistor is also gentle and the back gate current does not also fluctuate greatly and is substantially constant. Thus, according to this embodiment, it is possible to suppress occurrence of power noise that causes malfunctions of a logic circuit and an analog circuit, element breakdown by occurrence of a pulse voltage equal to or higher than a withstand voltage, and the like.

The disclosed constant voltage circuit can linearly change and control the voltage to be supplied to the back gate of the output transistor and can suppress a fluctuation in the output voltage.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A constant voltage circuit, comprising:

an error amplifier circuit configured to amplify a difference voltage between an output voltage and a reference voltage;

an output transistor configured to control the output voltage based on an output of the error amplifier circuit;

a detection circuit configured to detect a leakage current of the output transistor; and a first voltage generation circuit configured to generate a voltage proportional to the leakage current detected by the detection circuit, wherein the first voltage generation circuit raises a voltage to be generated according to an increase in the leakage current, and an output of the first voltage generation circuit is coupled to a back gate of the output transistor.

2. The constant voltage circuit according to claim 1, wherein the detection circuit comprises a first transistor including a gate coupled to a power supply, a source coupled to the power supply, and a drain coupled to an input of the first voltage generation circuit.

3. The constant voltage circuit according to claim 2, wherein the power supply is supplied to a back gate of the first transistor.

4. The constant voltage circuit according to claim 2, wherein a back gate of the first transistor is coupled to an output of the first voltage generation circuit.

5. The constant voltage circuit according to claim 1, wherein the first voltage generation circuit comprises:

an oscillation circuit configured to output an oscillation signal including an oscillation frequency corresponding to a current to be input; and a charge pump circuit configured to receive the oscillation signal output from the oscillation circuit and output a voltage corresponding to the oscillation frequency of the oscillation signal.

6. The constant voltage circuit according to claim 1, wherein the first voltage generation circuit operates when the leakage current detected by the detection circuit is larger than a first threshold value, and halts when the leakage current is smaller than the first threshold value.

7. The constant voltage circuit according to claim 1, further comprising:

a second transistor including a gate coupled to the output of the error amplifier circuit; and a second voltage generation circuit configured to generate a voltage proportional to a current of the second transistor, wherein the second voltage generation circuit drops a voltage to be generated according to an increase in the current of the second transistor, and an output of the second voltage generation circuit is coupled to the back gate of the output transistor and a back gate of the second transistor.

8. The constant voltage circuit according to claim 7, wherein the second voltage generation circuit comprises:

a first constant current source is coupled to a drain of the second transistor;

a third transistor including a drain and a gate coupled to a coupling node between the drain of the second transistor and the first constant current source; and a fourth transistor including a gate coupled to the third transistor in a current mirror manner, and a drain coupled to the output of the second voltage generation circuit.

9. The constant voltage circuit according to claim 7, wherein the second voltage generation circuit operates when the current of the second transistor is larger than a second threshold value, and halts when the current of the second transistor is smaller than the second threshold value.

10. A constant voltage circuit, comprising:

an error amplifier circuit configured to amplify a difference voltage between an output voltage and a reference voltage;

an output transistor configured to control the output voltage based on an output of the error amplifier circuit;

a first transistor including a gate coupled to the output of the error amplifier circuit;

a first constant current source is coupled to a drain of the first transistor;

a second transistor including a drain and a gate coupled to a coupling node between the drain of the first transistor and the first constant current source;

a third transistor including a gate coupled to the second transistor; and a first voltage generation circuit configured to generate a voltage proportional to a current of the third transistor, wherein the first voltage generation circuit raises a voltage to be generated according to a decrease in the current of the third transistor, and an output of the first voltage generation circuit is coupled to a back gate of the output transistor.

11. The constant voltage circuit according to claim 10, wherein the first voltage generation circuit comprises:

an oscillation circuit configured to output an oscillation signal including an oscillation frequency corresponding to a current to be input; and a charge pump circuit configured to receive the oscillation signal output from the oscillation circuit and output a voltage corresponding to the oscillation frequency of the oscillation signal.

12. The constant voltage circuit according to claim 10, wherein the first voltage generation circuit operates when the current of the third transistor is smaller than a first threshold value, and halts when the current of the third transistor is larger than the first threshold value.

13. The constant voltage circuit according to claim 10, further comprising:

a fourth transistor including a gate coupled to the output of the error amplifier circuit; and a second voltage generation circuit configured to generate a voltage proportional to a current of the fourth transistor, wherein the second voltage generation circuit drops a voltage to be generated according to an increase in the current of the fourth transistor, and an output of the second voltage generation circuit is coupled to the back gate of the output transistor and a back gate of the fourth transistor.

14. The constant voltage circuit according to claim 13, wherein the second voltage generation circuit comprises:

a second constant current source is coupled to a drain of the fourth transistor;

a fifth transistor including a drain and a gate coupled to a coupling node between the drain of the fourth transistor and the second constant current source; and a sixth transistor including a gate coupled to the fifth transistor, and a drain coupled to the output of the second voltage generation circuit.

15. The constant voltage circuit according to claim 13, wherein the second voltage generation circuit operates when the current of the fourth transistor is larger than a second threshold value, and halts when the current of the fourth transistor is smaller than the second threshold value.

16. A constant voltage circuit comprising:

an error amplifier circuit configured to amplify a difference voltage between an output voltage and a reference voltage;

an output transistor configured to control the output voltage based on an output of the error amplifier circuit;

a first transistor including a gate coupled to the output of the error amplifier circuit; and a first voltage generation circuit configured to generate a voltage proportional to a current of the first transistor, wherein the first voltage generation circuit comprises:

a first constant current source is coupled to a drain of the first transistor;

a second transistor including a drain and a gate coupled to a coupling node between the drain of the first transistor and the first constant current source; and a third transistor including a gate coupled to the second transistor, and a drain coupled to the output of the first voltage generation circuit, wherein the first voltage generation circuit drops a voltage to be generated according to an increase in the current of the first transistor, and an output of the first voltage generation circuit is coupled to back gates of the output transistor and the first transistor.

17. The constant voltage circuit according to claim 16, wherein the first voltage generation circuit operates when the current of the first transistor is larger than a first threshold value, and halts when the current of the first transistor is smaller than the first threshold value.

* * * * *